US010752456B2

(12) United States Patent
Ikegami

(10) Patent No.: US 10,752,456 B2
(45) Date of Patent: Aug. 25, 2020

(54) SHEET CONVEYING DEVICE AND IMAGE FORMING APPARATUS

(71) Applicant: Brother Kogyo Kabushiki Kaisha, Nagoya-shi, Aichi-ken (JP)

(72) Inventor: Yusuke Ikegami, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/260,190

(22) Filed: Jan. 29, 2019

(65) Prior Publication Data

US 2019/0233229 A1 Aug. 1, 2019

(30) Foreign Application Priority Data

Jan. 30, 2018 (JP) ..... 2018-013586

(51) Int. Cl.
*B65H 3/06* (2006.01)
*B65H 1/14* (2006.01)

(52) U.S. Cl.
CPC ..... *B65H 3/0669* (2013.01); *B65H 1/14* (2013.01); *B65H 3/0684* (2013.01); *B65H 2403/51* (2013.01)

(58) Field of Classification Search
CPC ... B65H 1/08; B65H 1/12; B65H 1/14; B65H 3/0669; B65H 3/0684; B65H 2403/421; B65H 2403/51; B65H 2403/533; B65H 2403/722; B65H 2405/324
See application file for complete search history.

(56) References Cited

U.S. PATENT DOCUMENTS

| | | | | |
|---|---|---|---|---|
| 7,461,840 | B2 | 12/2008 | Hattori | |
| 2001/0028144 | A1 | 10/2001 | Imura et al. | |
| 2003/0090053 | A1* | 5/2003 | Hsiao | B65H 3/0615 271/118 |
| 2005/0035531 | A1* | 2/2005 | Sasaki | B65H 1/12 271/126 |
| 2006/0180986 | A1* | 8/2006 | Hattori | B65H 1/14 271/110 |
| 2018/0141768 | A1* | 5/2018 | Ikegami | B65H 3/0684 |

FOREIGN PATENT DOCUMENTS

| | | |
|---|---|---|
| JP | 2001-341863 A | 12/2001 |
| JP | 2006-176321 A | 7/2006 |
| JP | 2009-007118 A | 1/2009 |

* cited by examiner

*Primary Examiner* — Prasad V Gokhale
(74) *Attorney, Agent, or Firm* — Banner & Witcoff, Ltd.

(57) ABSTRACT

A sheet conveying device includes a sheet supporting portion, a first lever pivotable by contact with a sheet supported by the sheet supporting portion, a hook movable together with the first lever, a first cam configured to, when engaging the hook, stop rotating in a rotation direction of the first cam, a spring configured to urge the first cam in a rotation direction, a sector gear rotatable together with the first cam, a drive gear configured to, when engaging the sector gear, transmit a drive force to the sector gear, a feed roller rotatable in contact with the sheet, and a drive mechanism configured to receive a drive force from the sector gear and move one of the feed roller and the sheet supporting portion toward the other of the feed roller and the sheet supporting portion, to increase contact pressure between the feed roller and the sheet.

7 Claims, 11 Drawing Sheets

SHEET CONVEYING DEVICE AND IMAGE FORMING APPARATUS

CROSS-REFERENCE TO RELATED APPLICATION

This application claims priority from Japanese Patent Application No. 2018-013586 filed on Jan. 30, 2018, the content of which is incorporated herein by reference in its entirety.

FIELD OF DISCLOSURE

Aspects disclosed herein relate to a sheet conveying device including a feed roller configured to feed a sheet supported on a sheet supporting portion and an image forming apparatus including the sheet conveying device.

BACKGROUND

A known sheet conveying device includes a sheet support portion configured to support a sheet thereon, and a feed roller movable to contact the sheet on the sheet support portion and configured to feed the sheet with increased contact pressure between the feed roller and the sheet.

The sheet conveying device uses a solenoid to urge the feed roller toward the sheet on the sheet support portion and increase the contact pressure between the feed roller and the sheet.

SUMMARY

Illustrative aspects of the disclosure provide a sheet conveying apparatus configured to enable a feed roller to reliably contact a sheet on a sheet supporting portion and increase contact pressure between the feed roller and the sheet, and provide an image forming apparatus including the sheet conveying device.

According to an aspect of the disclosure, a sheet conveying apparatus includes a sheet supporting portion configured to support a sheet, a first lever pivotable by contact with the sheet supported by the sheet supporting portion, a hook movable together with the first lever, a first cam rotatable and engageable with the hook, a spring, a sector gear, a drive gear, a feed roller, and a drive mechanism. The first cam is configured to, when engaging the hook, stop rotating in a rotation direction of the first cam. The spring is configured to urge the first cam in the rotation direction. The sector gear is rotatable together with the first cam. The rive gear is engageable with the sector gear. The drive gear is configured to, when engaging the sector gear, transmit a drive force to the sector gear. The feed roller is rotatable in contact with the sheet supported by the sheet supporting portion and configured to feed the sheet. The drive mechanism is configured to receive the drive force from the sector gear and move one of the feed roller and the sheet supporting portion toward the other of the feed roller and the sheet supporting portion, to increase contact pressure between the feed roller and the sheet supported by the sheet supporting portion.

According to another aspect of the disclosure, an image forming apparatus includes an image forming unit configured to form an image onto a sheet and the sheet conveying device.

This structure does not require a solenoid, but enables the sheet conveying device to increase the contact pressure between the feed roller and the sheet supported by the sheet supporting portion.

DETAILED DESCRIPTION

An illustrative embodiment of the disclosure will be described with reference to the accompanying drawings.

Overall Structure of Image Forming Apparatus

Figure 1:
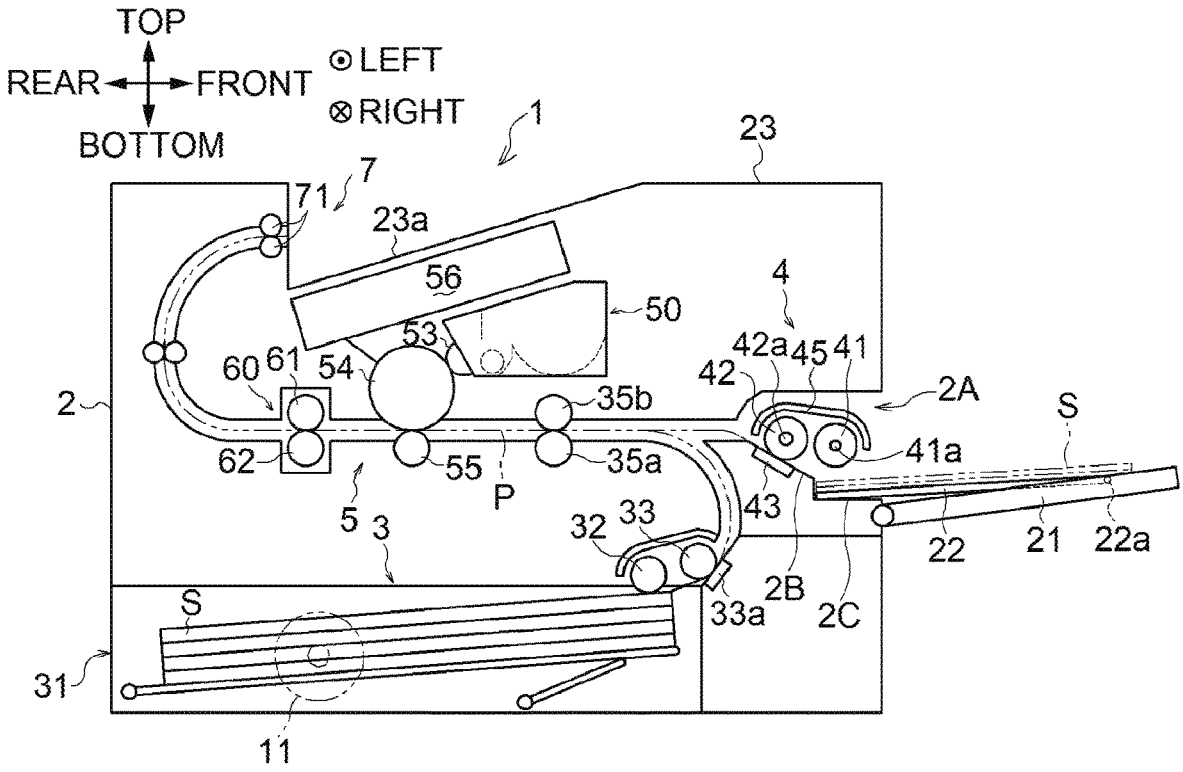
FIG. 1 is a cross sectional view of an image forming apparatus including a sheet conveying device with a support tray at a separation position.
Figure 2:
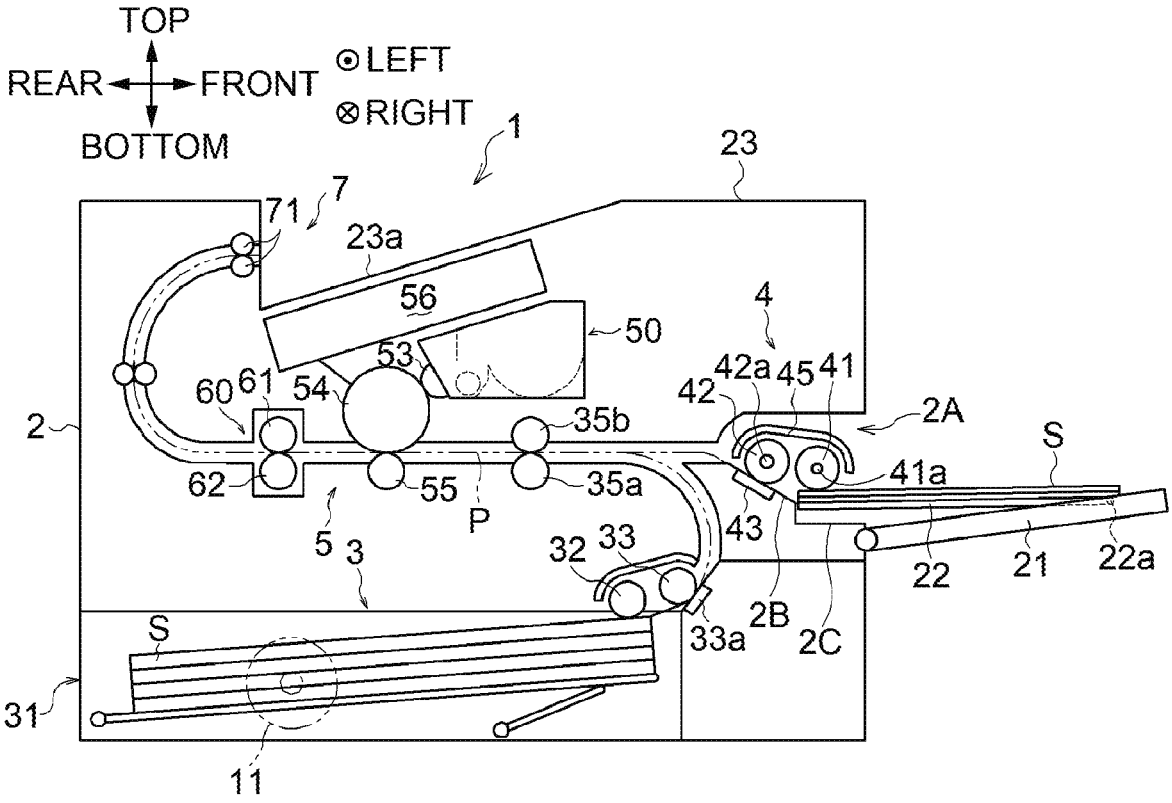
FIG. 2 is a cross sectional view of the image forming apparatus including the sheet conveying device with the support tray at a sheet feed position.

An image forming apparatus 1 illustrated in FIGS. 1 and 2 is an example of an image forming apparatus including a sheet conveying device according to an aspect of the disclosure. The image forming apparatus 1 includes a casing 2, an image forming unit 5, a sheet feed unit 3, a sheet conveying device 4, a discharge unit 7, and a motor 11.

The image forming unit 5 is configured to form an image on a sheet S. The sheet feed unit 3 is configured to feed a sheet S to the image forming unit 5. The sheet conveying device 4 is configured to convey a sheet S supported on a support tray 22 toward the image forming unit 5. The discharge unit 7 is configured to discharge the sheet having an image formed at the image forming unit 5 outside of the casing 2. The support tray 22 is an example of a sheet supporting portion configured to support a sheet.

In the following description, directions are defined based on FIG. 1. In FIG. 1, a right side is defined as a front or front side of the image forming apparatus 1, a left side is defined as a rear or rear side of the image forming apparatus 1, a side facing out of the page is defined as a left or left side of the image forming apparatus, a side facing into the page is defined as a right or right side of the image forming apparatus 1, an upper side is defined as a top or upper side of the image forming apparatus 1, and a lower side is defined as a bottom or lower side of the image forming apparatus 1.

The casing 2 is box-shaped, and accommodates the sheet feed unit 3, the image forming unit 5, and the discharge unit 7. The casing 2 has an opening 2A at its front, and includes a front cover 21 configured to open and close the opening 2A, and the support tray 22 supported by the front cover 21. When the front cover 21 is open, the support tray 22 is configured to support one or more sheets S thereon. The casing 2 includes an upper cover 23 to cover the upper surface of the casing 2.

The support tray 22 has a rotation axis 22*a* at its front end portion. The support tray 22 is pivotable about the rotation axis 22*a* and the front end portion of the support tray 22 is supported by the front cover 21. As illustrated in FIG. 1, the casing 2 has a support surface 2C at its front end portion. The support tray 22 has a rear end portion supported on the support surface 2C.

The upper cover 23 has an upper surface defining a sheet discharge tray 23*a*. The sheet discharge tray 23*a* is recessed downward relative to the upper surface and inclined downward to the rear.

The sheet feed unit 3 includes a sheet cassette 31, a feed roller 32, a separation roller 33, a separation pad 33*a*, and registration rollers 35*a*, 35*b*. The casing 2 defines inside a conveying path P extending from the sheet cassette 31 via the image forming unit 5 to the sheet discharge tray 23*a*.

The sheet cassette 31 supports a stack of sheets S. The feed roller 32 feeds a sheet S from the sheet cassette 31, and the separation roller 33 and the separation pad 33*a* separate the sheet S from subsequent sheets S, so that the sheet S is singly conveyed toward the conveying path P.

The sheet S conveyed to the conveying path P is conveyed by the registration rollers 35*a*, 35*b*, which are located downstream of the separation roller 33, toward the image forming unit 5. The registration rollers 35A, 35*b* temporarily stop the leading end of the sheet S, and then convey the sheet S toward the transfer position in the image forming unit 5 at a predetermined time.

The image forming unit 5 is disposed above the sheet cassette 31, and includes a process cartridge 50 configured to transfer an image on a sheet S conveyed from the sheet feed unit 3, an exposure unit 56 configured to expose a surface of a photosensitive drum 54 in the process cartridge 50, and a fixing unit 60 configured to fix the image transferred on the sheet S by the process cartridge 50.

The process cartridge 50 includes a developing roller 53, the photosensitive drum 54, and a transfer roller 55.

The exposure unit 56 includes a laser diode, a polygon mirror, a lens, and a reflecting mirror, and is configured to emit a laser beam onto a surface of the photosensitive drum 54 based on image data inputted in the image forming apparatus 1 to expose the surface.

The photosensitive drum 54 is disposed adjacent to the developing roller 53. The surface of the photosensitive drum 54 is positively and uniformly charged by a charger (not illustrated), and then exposed by the exposure unit 56. Exposed areas on the surface of the photosensitive drum 54 are lower in electric potential than the other areas thereon, so that an electrostatic latent image is formed on the surface of the photosensitive drum 54 based on the image data.

The electrostatic latent image on the surface of the photosensitive drum 54 is developed into a visible developer image with positively charged toner supplied from the developing roller 53.

The transfer roller 55 is disposed facing the photosensitive drum 54, and receives a negative transfer bias from a bias applying member (not illustrated). While a sheet S is nipped at a transfer position between the transfer roller 55 receiving the transfer bias and the photosensitive drum 54 carrying the developer image thereon, the developer image on the photosensitive drum 54 is transferred to the sheet S.

The fixing unit 60 includes a heat roller 61 and a pressure roller 62. The heat roller 61 is driven by a drive force from the motor 11, and is heated by electric power supplied from a power source (not illustrated). The pressure roller 62 is disposed facing the heat roller 61, and rotated by the rotation of the heat roller 61. The sheet S having the developer image is conveyed to the fixing unit 60, in which the sheet S is nipped and conveyed by the heat roller 61 and the pressure roller 62, and thus the developer image is fixed onto the sheet S.

The discharge unit 7 includes discharge rollers 71, 71 and is configured to discharge the sheet conveyed from the fixing unit 60 outside of the casing 2. More specifically, the discharge unit 7 uses the discharge rollers 71, 71 to discharge the sheet S conveyed from the fixing unit 60 to the sheet discharge tray 23*a* defined at the upper surface of the upper cover 23.

The sheet conveying device 4 is configured to convey a sheet S supported on the support tray 22 through the opening 2A of the casing 2 toward the image forming unit 5.

First Embodiment of Sheet Conveying Device

A first embodiment of the sheet conveying device 1 will be described.

As illustrated in FIGS. 1 and 2, the sheet conveying device 4 includes the support tray 22, a feed roller 41, a separation roller 42, a separation pad 43, and a roller holder 45.

The support tray 22 supports one or more sheets S. The feed roller 41 is rotatable to contact and feed a sheet S supported on the support tray 22.

The pressure roller 42 is disposed downstream of the feed roller 41 in a sheet conveyance direction in which a sheet S is conveyed. The separation roller 42 conveys the sheet S fed by the feed roller 41. The separation pad 43 is disposed facing the separation roller 42. The casing 2 has a guide surface 2B configured to guide a sheet S. The guide surface 2B is inclined upward to the rear. The separation pad 43 is disposed on the guide surface 2B.

The support surface 2C supporting the rear end portion of the support tray 22 is located in front of and below the guide surface 2B. The guide surface 2B and the support surface 2C form a step therebetween.

The support tray 22 is pivotable about the rotation axis 22*a* between a separation position (FIG. 1) where the support tray 22 is away from the feed roller 41 and a sheet feed position (FIG. 2) where the support tray 22 pivots upward from the separation position to allow a sheet S supported on the support tray 22 to contact the feed roller 41. When the support tray 22 is at the sheet feed position, the feed roller 41 is pressed against a sheet S supported on the support tray 22, resulting in increased contact pressure between the feed roller 41 and the sheet S.

The feed roller 41 and the separation roller 42 are driven by the motor 11. The roller holder 45 holds the feed roller 41 and the separation roller 42.

The feed roller 41 has a rotation shaft 41*a* and is rotatable about the rotation shaft 41*a*. The separation roller 42 has a rotation shaft 42*a* and is rotatable about the rotation shaft 42*a*. The roller holder 45 supports the feed roller 41 such that the feed roller 41 does not move vertically.

When the support tray 22 is at the sheet feed position, the sheet conveying device 4 drives the feed roller 41 and the separation roller 42 to separate a sheet S between the separation roller 42 and the separation pad 43 and feed the sheet S toward the image forming unit 5.

Figure 3:
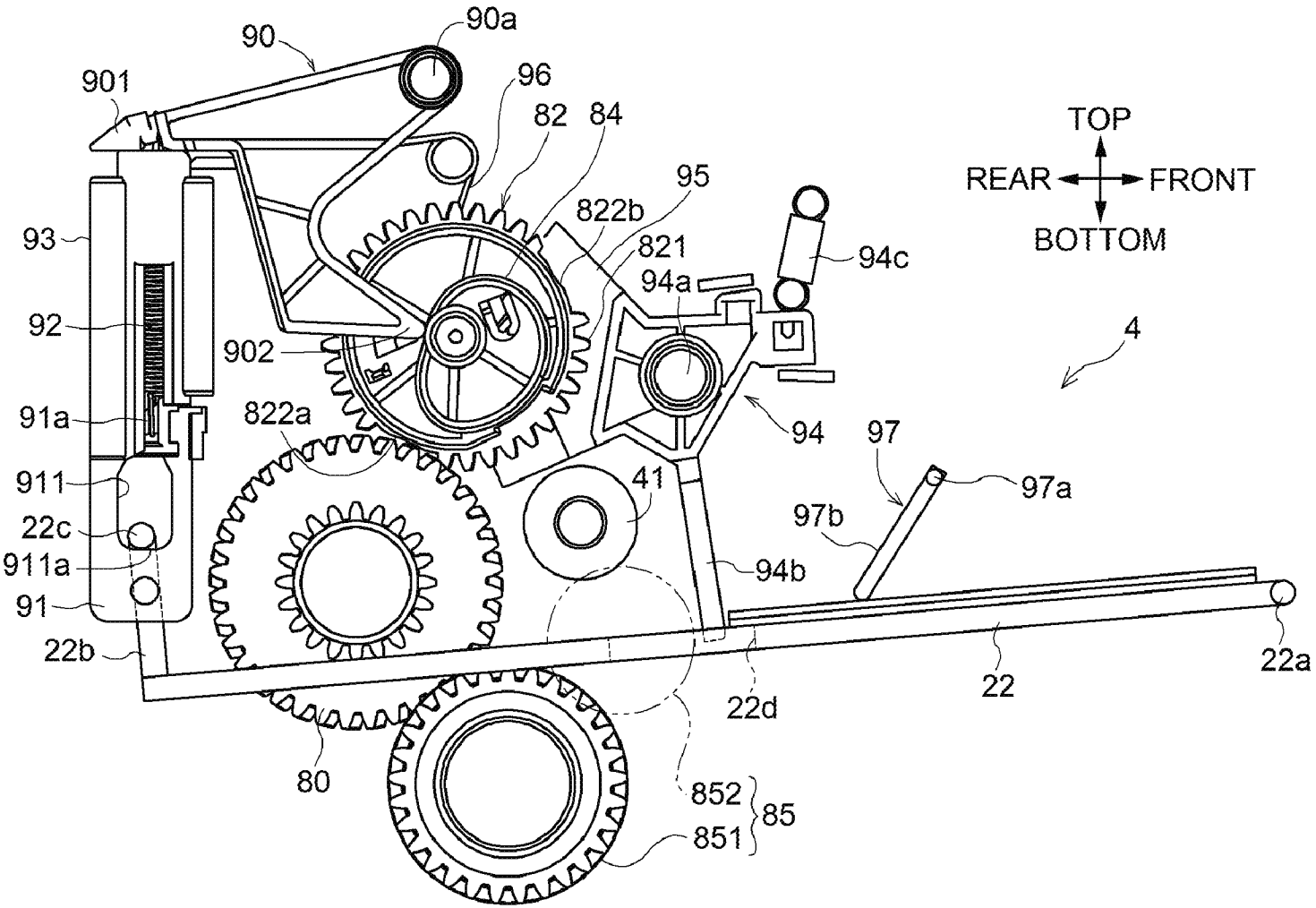
FIG. 3 is a left side view of the sheet conveying device in which a selector lever is at a first lever position and the support tray is at the separation position.
Figure 4:
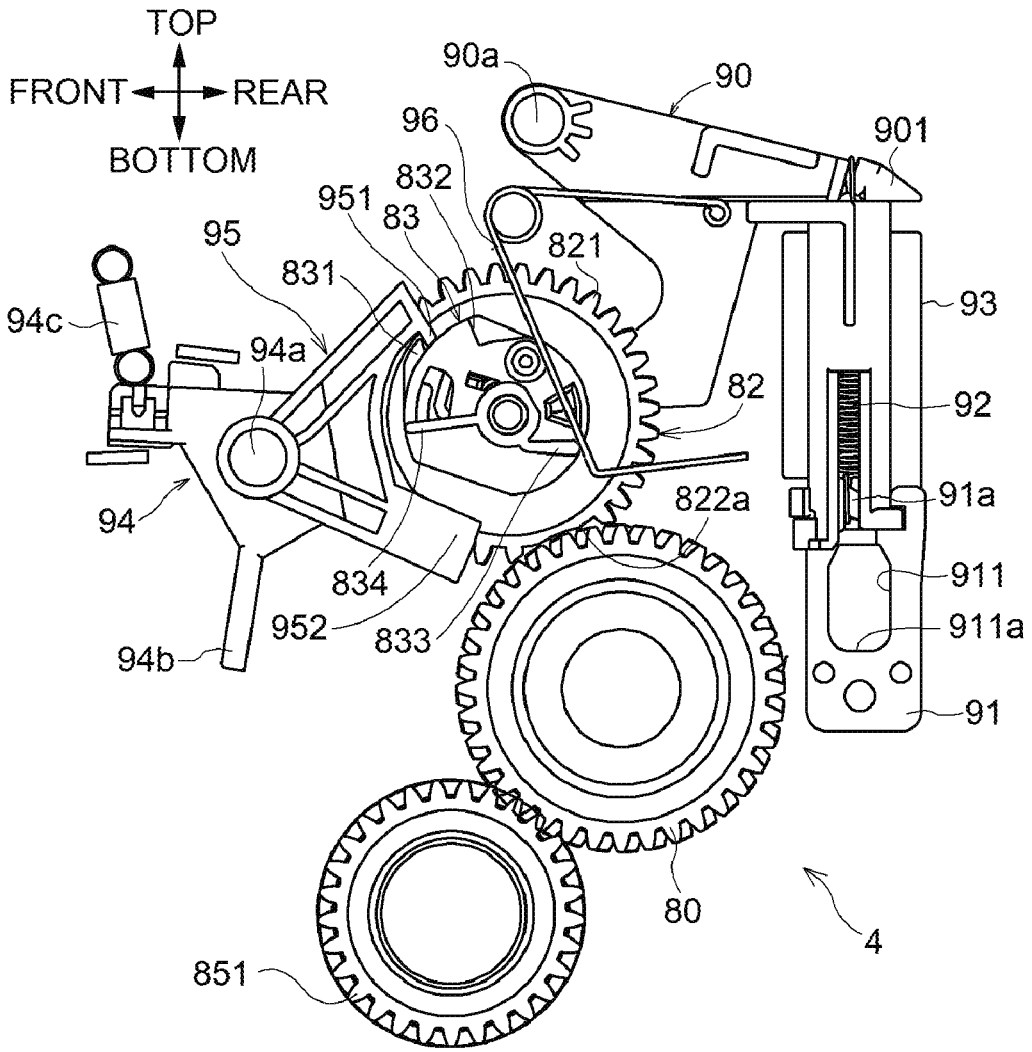
FIG. 4 is a right side view of the sheet conveying device in which the selector lever is at the first lever position and the support tray is at the separation position.

As illustrated in FIGS. 3 and 4, the sheet conveying device 4 includes a contact 91, an arm 90, a tension spring 92, a pre-loading member 93, a drive gear 80, a sector gear 82, and a cam 84. The cam 84 is an example of a second cam.

The support tray 22 includes a support arm 22*b* extending upward from its rear end portion. The support arm 22*b* has a support protrusion 22*c* extending in the left-right direction at its upper end.

The contact 91 is engageable with the support protrusion 22*c* of the support tray 22. The arm 90 is movable vertically. The tension spring 92 is disposed between the contact 91 and the arm 90. The pre-loading member 93 is disposed between the contact and the arm 90, and holds the tension spring 92 such that it is stretched beyond its natural length. The drive gear 80 is driven by the motor 11.

The sector gear 82 is engageable with the drive gear 80, and includes a toothed portion 821 where teeth are provided, a first toothless portion 822*a* where no teeth are provided, and a second toothless portion 822*b* provided at a position different from the first toothless portion 822*a*.

When the sector gear 82 rotates to a position where the toothed portion 821 faces the drive gear 80, the toothed portion 821 engages with the drive gear 80. When the sector gear 82 rotates to a position where the first toothless portion 822*a* or second toothless portion 822*b* faces the drive gear 80, the sector gear 82 disengages from the drive gear 80.

The sector gear 82 is driven by the drive gear 80 when the toothed portion 821 engages with the drive gear 80. That is, the drive gear 80 transmits a drive force to the sector gear 82 when engaging with the sector gear 82.

The sector gear 82 rotates in engagement with the drive gear 80. This is a rotation direction of the sector gear 82. For example, the sector gear 82 engages with the drive gear 80 and rotates clockwise in FIG. 4.

The cam 84 is rotatable together with the sector gear 82. The cam 84 and the sector gear 82 may be made of, for example, resin, constitute a single-piece assembly, and be inseparable from each other.

The tension spring 92 has a first end (or upper end in FIGS. 3 and 4) engaging with an engaging portion 901 of the arm 90, and a second end (or lower end in FIGS. 3 and 4) engaging with an engaging portion 91*a* of the contact 91. The tension spring 92 pulls the arm 90 and the contact 91 toward each other.

The arm 90 is pivotable about a pivot shaft 90*a*, and configured to allow the engaging portion 901 engaging with the tension spring 92 to move vertically.

The sheet conveying device 4 is configured such that the vertical movement of the engaging portion 901 of the arm 90 allows the support tray 22 to pivot vertically.

The arm 90 includes a contact portion 902 engageable with the cam 84.

When the contact portion 902 of the arm 90 contacts the cam 84 being rotated, the arm 90 pivots between a first position (FIGS. 7 and 8) where the engaging portion 901 is at an upper position and a second position (FIGS. 3 and 4) where the engaging portion 901 is at a lower position. That is, the cam 84 moves the engaging portion 901 of the arm 90 vertically. The arm 90 contacts the cam 84, and thus pivots along with the rotation of the cam 84.

More specifically, when the sector gear 82 rotates to a position where the first toothless portion 822*a* faces the drive gear 80, the cam 84 moves the arm 90 to the second position. When the sector gear 82 rotates to a position where the second toothless portion 822*b* faces the drive gear 80, the cam 84 moves the arm 90 to the first position.

The pre-loading member 93 is shaped like a cylinder extending vertically, and accommodates the tension spring 92 inside.

When the arm 90 is at the second position, the engaging portion 901 contacts an upper end surface of the pre-loading member 93, and a lower end portion of the pre-loading member 93 is connected with an upper end portion of the contact 91.

The pre-loading member 93 has the upper end surface contacting the engaging portion 901 and the lower end surface connected with the contact 91, thus maintaining a uniform distance between the engaging portion 901 and the contact 91. The uniform distance is required to stretch the tension spring 92, which is disposed between the arm 90 and the contact 91, beyond its natural length, and the tension spring 92 is maintained with an urging force applied in a direction where the tension spring 92 is stretched.

As the pre-loading member 93 is disposed between the engaging portion 901 and the contact 91, the urging force of the tension spring 92 is applied to the engaging portion 901 and the contact 91 to move toward each other, thus resulting in the engaging portion 901 pressed on the upper end surface of the pre-loading member 93.

The contact 91 moves vertically along with the vertical movement of the engaging portion 901 of the arm 90. The contact 91 has a hole 911 receiving the support protrusion 22*c* of the support tray 22. The hole 911 has an inner surface defining its circumference. The inner surface of the hole 911 includes a bottom surface 911 at a lower end of the hole 911. The support protrusion 22*c* of the support tray 22 engages with the bottom surface 911*a* of the hole 911.

The support protrusion 22*c* of the support tray 22 engages in the hole 911 in the contact 91. This connects the arm 90 and the support tray 22. The tension spring 92 and the contact 91 constitute a connector that connects the arm 90 and the arm 22.

When the arm 90 is at the second position, the support tray 22 is at the separation position. When the cam 84 moves the arm 90 from the second position to the first position, the support protrusion 22*c* moves upward, and the support tray 22 pivots from the separation position to the sheet feed position close to the feed roller 41. Conversely, when the arm 90 moves from the first position to the second position, the support protrusion 22*c* moves downward, and the support tray 22 pivots from the sheet feed position to the separation position away from the feed roller 41.

The sheet conveying device 4 includes the cam 84, the arm 90, and the tension spring 92 and the contact 91, which form a drive mechanism configured to pivot the support tray 22 between the separation position and the sheet feed position.

The drive mechanism is configured to receive a drive force from the sector gear 82 and move the support tray 22 toward the feed roller 41, to increase the contact pressure between the feed roller 41 and a sheet S on the support tray 22.

The sheet conveying device 4 includes a selector lever 94, a hook 95, a rock cam 83, a spring 96, and a drive force transmitting device 85. The selector lever 94 is an example of a first lever. The rock cam 83 is an example of a first cam.

The selector lever 94 is located to contact a sheet S supported on the support tray 22, and is pivotable by contact with the sheet S. The selector lever 94 includes a pivot shaft 94*a* and a contact portion 94*b*. The pivot shaft 94*a* is disposed above the support tray 22 and the selector lever 94 is pivotable about the pivot shaft 94*a*. The contact portion 94*b* is located below the pivot shaft 94*a* to contact a sheet S. The contact portion 94*b* extends downward from the pivot shaft 94*a*.

The selector lever 94 is pivotable about the pivot shaft 94*a* between a first lever position (FIG. 3) where the contact portion 94*b* is inclined to the front and a lower end portion of the contact portion 94*b* is in a sensor hole 22*d* in the support tray 22 and a second lever position (FIG. 5) where the contact portion 94*b* is inclined to the rear and the lower end portion of the contact portion 94*b* is upward out of the sensor hole 22*d* in the support tray 22.

The selector lever 94 is urged to the first lever position by an urging spring 94*c* when not subjected to an external force.

When the sensor hole 22*d* is exposed or not covered with a sheet S on the support tray 22, the urging force of the urging spring 94*c* enables insertion of the lower end portion of the contact portion 94*b* into the sensor hole 22*d*. In this state, the selector lever 94 is at the first lever position.

When a sheet S is supported on the support tray 22, the sheet S blocks the sensor hole 22*d*, and thus the lower end portion of the contact portion 94*b* is not inserted into the sensor hole 22*d*. In this state, the selector lever 94 is at the second lever position.

The hook 95 is movable together with the selector lever 94. The hook 95 and the selector lever 94 may be made of, for example, resin, constitute a single-piece assembly, and be inseparable from each other. The hook 95 includes a first hook portion 951 and a second hook portion 952.

The rock cam 83 is rotatable together with the sector gear 82 and engageable with the hook 95. The rock cam 83 includes a first cam portion 831 engageable with the first hook portion 951 of the hook 95, and a second cam portion 832 engageable with the second hook portion 952 of the hook 95. The rock cam 83 is rotatable together with the cam 84. The rock cam 83, the cam 84, and the sector gear 82 may be made of, for example, resin, constitute a single-piece assembly, and be inseparable from each other.

When the sector gear 82 rotates to a position where the first toothless portion 822*a* faces the drive gear 80, the first cam portion 951 is engageable with the first cam portion 831. When the sector gear 82 rotates to a position where the second toothless portion 822*b* faces the drive gear 80, the second hook portion 952 is engageable with the second cam portion 832.

When the selector lever 94 is at the first lever position, the first hook portion 951 engages with the first cam portion 831, the second hook portion 952 is away from the second cam portion 832, and thus rotation of the sector gear 82, which is driven by the drive gear 80, is stopped at a position where the first toothless portion 822*a* faces the drive gear 80.

When the selector lever 94 is at the second lever position, the second hook portion 952 engages with the second cam portion 832, and the first hook portion 951 is away from the first cam portion 831, and thus rotation of the sector gear 82, which is driven by the drive gear 80, is stopped at a position where the second toothless portion 822*b* faces the drive gear 80.

The rock cam 83 is rotatable together with the sector gear 82. Rotation of the rock gear 83 is restricted by engagement between the first hook portion 951 and the first cam portion 831. Rotation of the rock cam 83 is also restricted by engagement between the second hook portion 952 and the second cam portion 832.

When the selector lever 94 is at the first lever position and rotation of the sector gear 82 is stopped at the position where the first toothless portion 822*a* faces the drive gear 80, the sector gear 82 disengages from the drive gear 80. Thus, the drive gear 80 is rotatable while rotation of the sector gear 82 is stopped.

Similarly, when the selector lever 94 is at the second lever position and rotation of the sector gear 82 is stopped at the position where the second toothless portion 822*b* faces the drive gear 80, the sector gear disengages from the drive gear 80. Thus, the drive gear 80 is rotatable while rotation of the sector gear 82 is stopped.

The rock cam 83 includes a first engaging piece 833 and a second engaging piece 834. The first engaging piece 833 and the second engaging piece 834 are rotatable together with the sector gear 82.

As illustrated in FIG. 4, when the sector gear 82 rotates to a position where the first toothless portion 822*a* faces the drive gear 80, the spring 96 engages with the first engaging piece 833 to urge the sector gear 82 in its rotation direction.

When the spring 96 engages with the first engaging piece 833 and the selector gear 94 moves from the first lever position, to the second lever position, the first hook portion 951 disengages from the first cam portion 831, and the sector gear 82 is rotatable in its rotation direction from the position where the first toothless portion 822*a* faces the drive gear 80.

The spring 96 urges the sector gear 82 to rotate to a position where the toothed portion 821, located upstream of the first toothless portion 822*a* in the rotation direction of the sector gear 82, engages with the drive gear 80.

That is, the spring 96 urges the sector gear 82 to rotate from the position where the first toothless portion 822*a* faces the drive gear 80, to the position where the toothed portion 821 engages with the drive gear 80.

Figure 8:
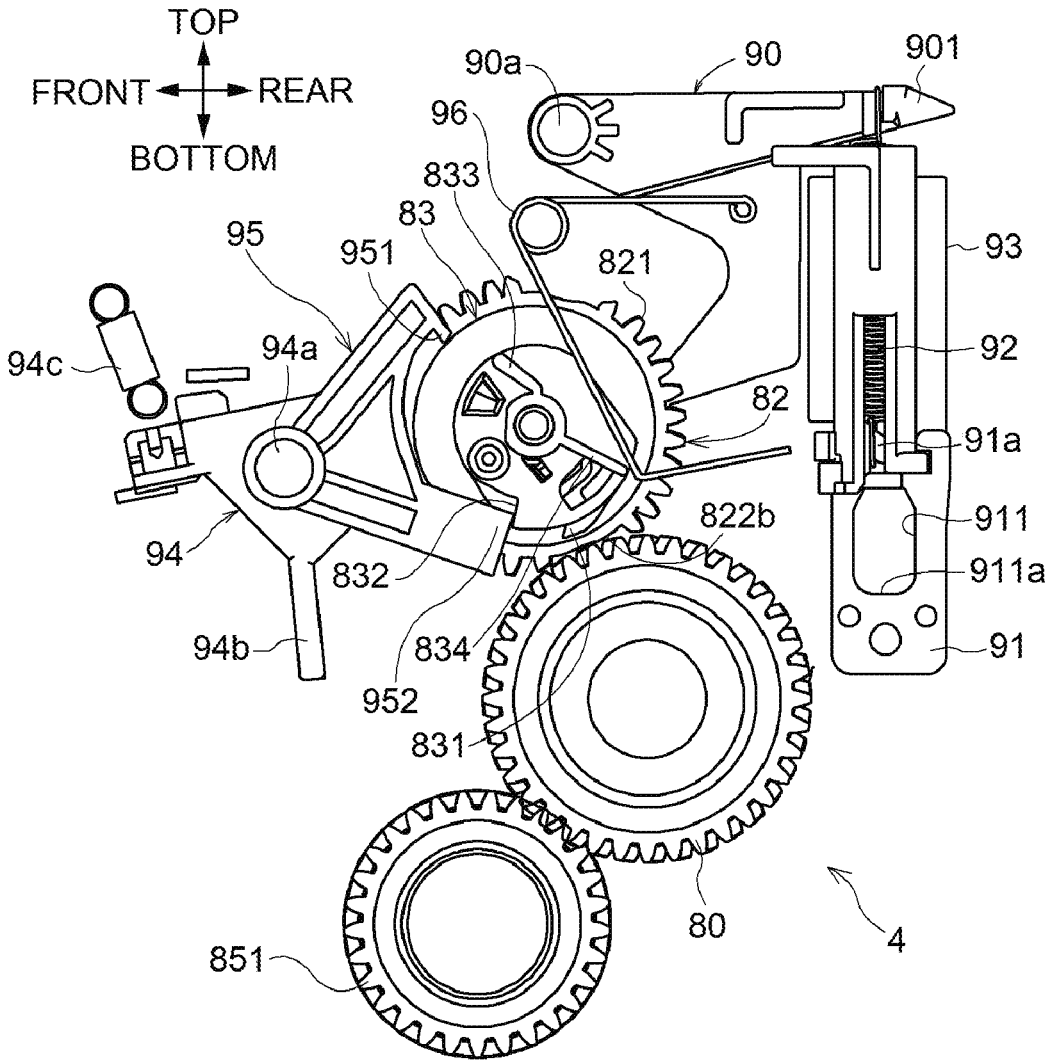
FIG. 8 is a right side view of the sheet conveying device in which the selector lever is at the second lever position and the support tray is at the sheet feed position.

As illustrated in FIG. 8, when the sector gear 82 rotates to a position where the second toothless portion 822*b* faces the drive gear 80, the spring 96 engages with the second engaging piece 834 to urge the sector gear 82 in its rotation direction.

When the spring 96 engages with the first engaging piece 834 and the selector gear 94 moves from the second lever position to the first lever position, the second hook portion 952 disengages from the second cam portion 832, and the sector gear 82 is rotatable in its rotation direction from the position where the second toothless portion 822*b* faces the drive gear 80.

The spring 96 urges the sector gear 82 to rotate to a position where the toothed portion 821, located upstream of the second toothless portion 822*b* in the rotation direction of the sector gear 82, engages with the drive gear 80.

That is, the spring 96 urges the sector gear 82 to rotate from the position where the second toothless portion 822*b* faces the drive gear 80, to the position where the toothed portion 821 engages with the drive gear 80.

The drive force transmission device 85 is configured to transmit a drive force from the drive gear to the feed roller 41. The drive force transmission device 85 includes an intermediate gear 851 engageable with the drive gear 80, and an electromagnetic clutch 852 disposed between the intermediate gear 851 and the feed roller 41. The electromagnetic clutch 852 is configured to selectively allow and interrupt transmission of a drive force from the intermediate gear 851 to the feed roller 41 under control by a controller in the image forming apparatus 1. In other words, the electromagnetic clutch 852 has a transmission state where a drive force is transmitted from the intermediate gear 851 to the feed roller 41 and an interruption state where the transmission of the drive force from the intermediate gear 851 to the feed roller 41 is interrupted, which are selected by the controller.

Operation of Sheet Conveying Device

The sheet conveying device 4 described above operates as follows.

The sheet conveying device 4 illustrated in FIGS. 3 and 4 is in its initial state. When the sheet conveying device 4 is in the initial state and no sheets S are supported on the support tray 22, the selector lever 94 is at the first lever position, the first hook portion 951 of the hook 95 engages with the first cam portion 831, and rotation of the sector gear 82 is stopped at the position where the first toothless portion 822*a* faces the drive gear 80. The spring 96 engages with the first engaging piece 833 and urges the sector gear 82 in its rotation direction.

In this state, the sector gear 82 disengages from the drive gear 80, and the drive gear 80 receives drive force from the motor 11 and rotates. The controller of the image forming apparatus 1 disengages the electromagnetic clutch 852, and thus the feed roller 41 is not driven.

The arm 90 is at the second position, and the support tray 22 is at the separation position.

Figure 5:
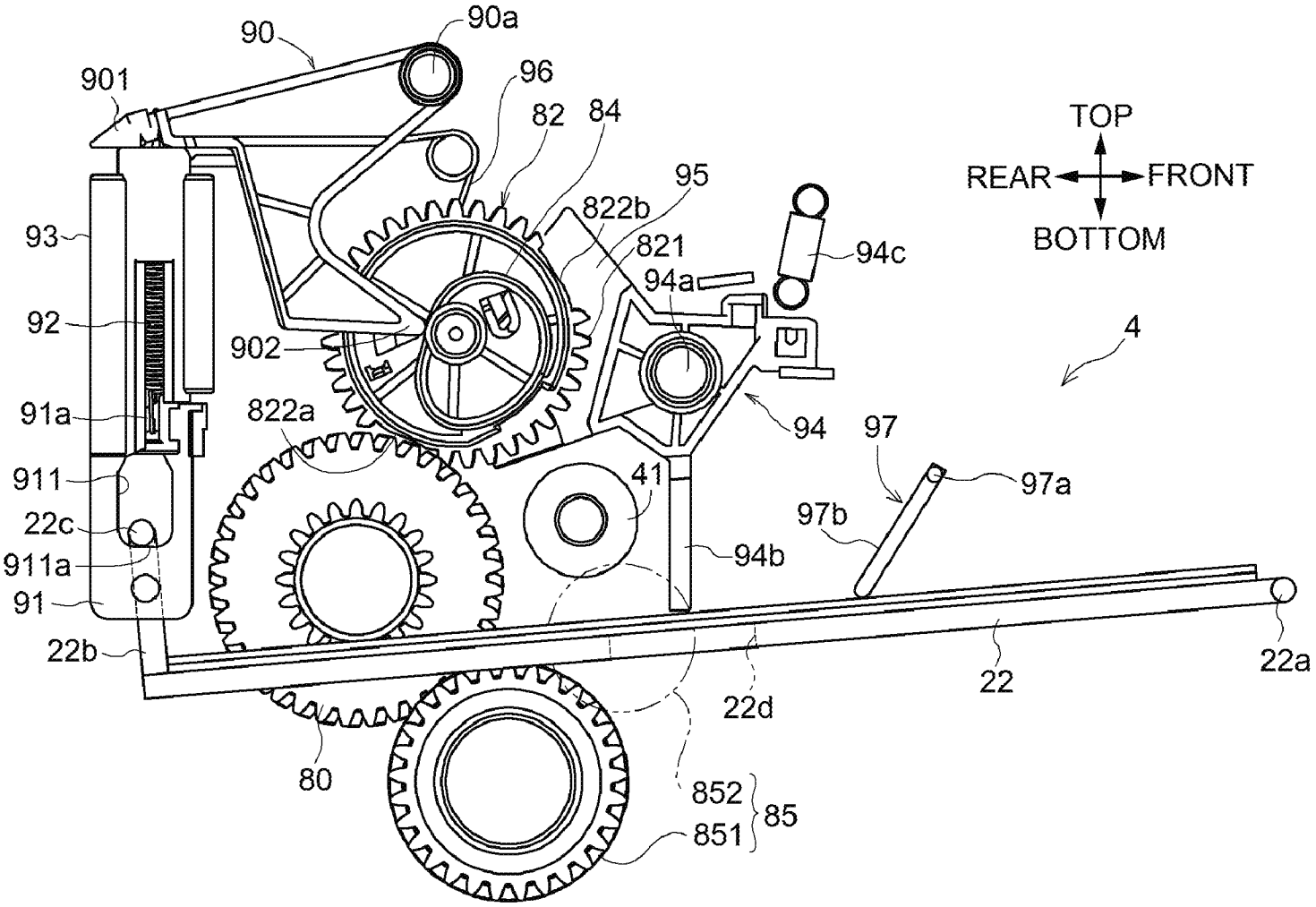
FIG. 5 is a left side view of the sheet conveying device in which the selector lever is at a second lever position and the support tray is at the separation position.
Figure 6:
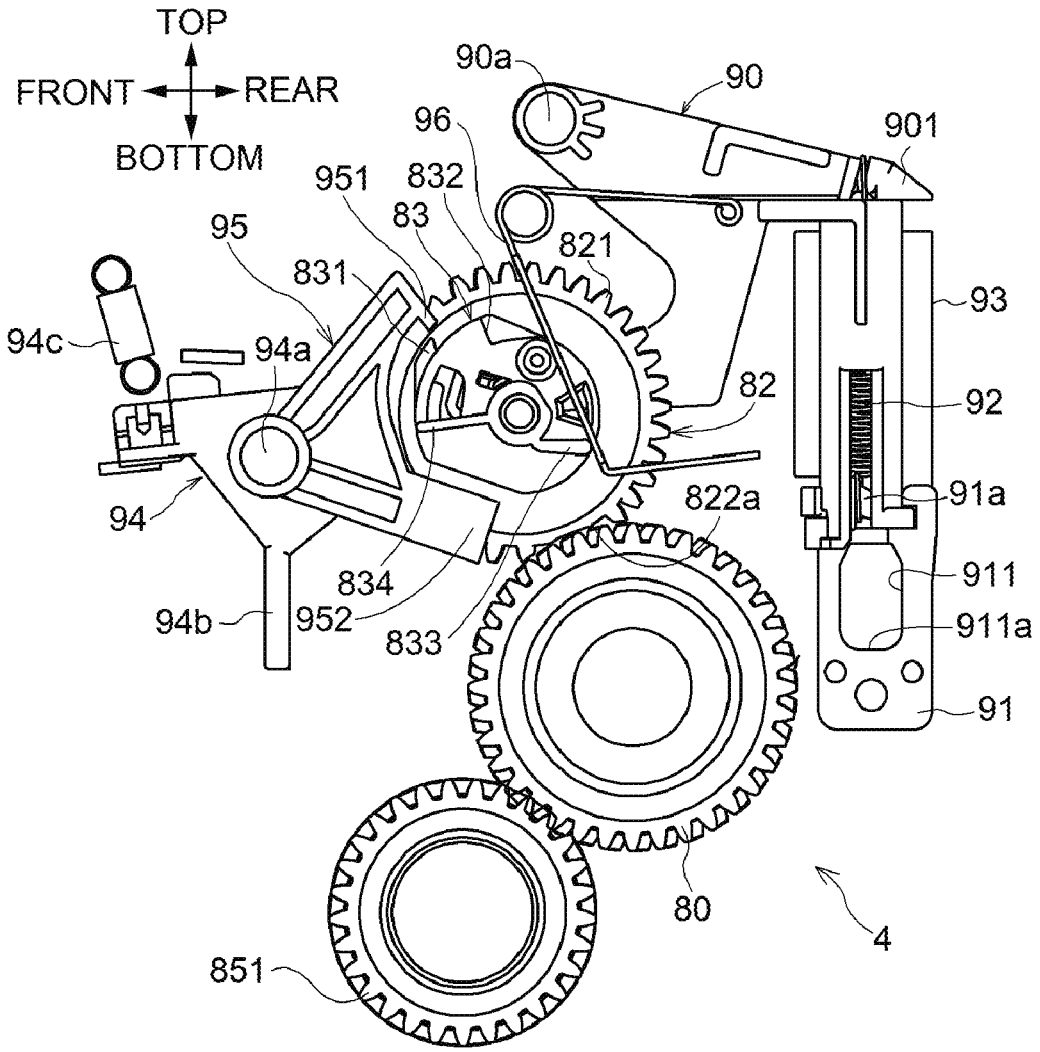
FIG. 6 is a right side view of the sheet conveying device in which the selector lever is at the second lever position and the support tray is at the separation position.

When a sheet S is inserted to the rear on the support tray 22, a rear end (left end in FIG. 3) of the sheet S contacts and presses the contact portion 94*b* of the selector lever 94 to the rear. As illustrated in FIGS. 5 and 6, the selector lever 94 moves from the first lever position to the second lever position accordingly.

When the selector lever 94 is at the second lever position, the lower end portion of the contact portion 94*b* is upward out of the sensor hole 22*d* in the support tray 22. This enables insertion of the sheet S all the way to the rear end of the support tray 22. The sheet S inserted to the rear end of the support tray 22 is supported on the support tray 22 (FIG. 5).

The sheet conveying device 4 includes a sheet pressing lever 97 disposed in front of or upstream of the selector lever 94 in the sheet conveyance direction. The sheet pressing lever 97 is an example of a second lever.

The sheet pressing lever 97 is disposed above the support tray 22 and includes a pivot shaft 97*a* and a pressing portion 97*b* supported by the pivot shaft 97*a*. The sheet pressing lever 97 is pivotable about the pivot shaft 97*a*. The pressing portion 97*b* is rotatable vertically. The pressing portion 97*b* is rotatable downward by its own weight to contact the support tray 22 supporting no sheets S thereon.

When a sheet S is inserted to the rear on the support tray 22, a rear end (left end in FIG. 5) of the sheet S contacts the pressing portion 97*b* of the sheet pressing lever 97. When the sheet S is further inserted, the sheet S presses and raises the pressing portion 97*b*, entering between the support tray 22 and the pressing portion 97*b*. When the sheet S enters between the support tray 22 and the pressing portion 97*b*, the pressing portion 97*b* presses the sheet S toward the support tray 22.

When the sheet S is inserted further rearward, the sheet S pressed by the pressing portion 97*b* contacts the contact portion 94*b* of the selector lever 94. The sheet S pressed by the pressing portion 97*b* has greater stiffness to press into contact with the contact portion 94*b* without buckling, thus enabling the selector lever 94 to move from the first lever position to the second lever position.

This effect works remarkably well when the number of sheets S to be inserted on the support tray 22 is low, for example, one.

When the selector lever 94 moves from the first lever position to the second lever position, the hook 95 rotates together with the selector lever 94, the first hook portion 951 disengages from the first cam portion 831, and the sector gear 82 becomes rotatable. The sector gear 82 receives the urging force of spring 96 and starts to rotate in the rotation direction of the sector gear 82. Rotation of the sector gear 82 by the urging force of the spring 96 enables engagement between the toothed portion 821 of the sector gear 82 and the drive gear 80, allowing the sector gear 82 to receive the drive force from the drive gear 80 and rotate.

Figure 7:
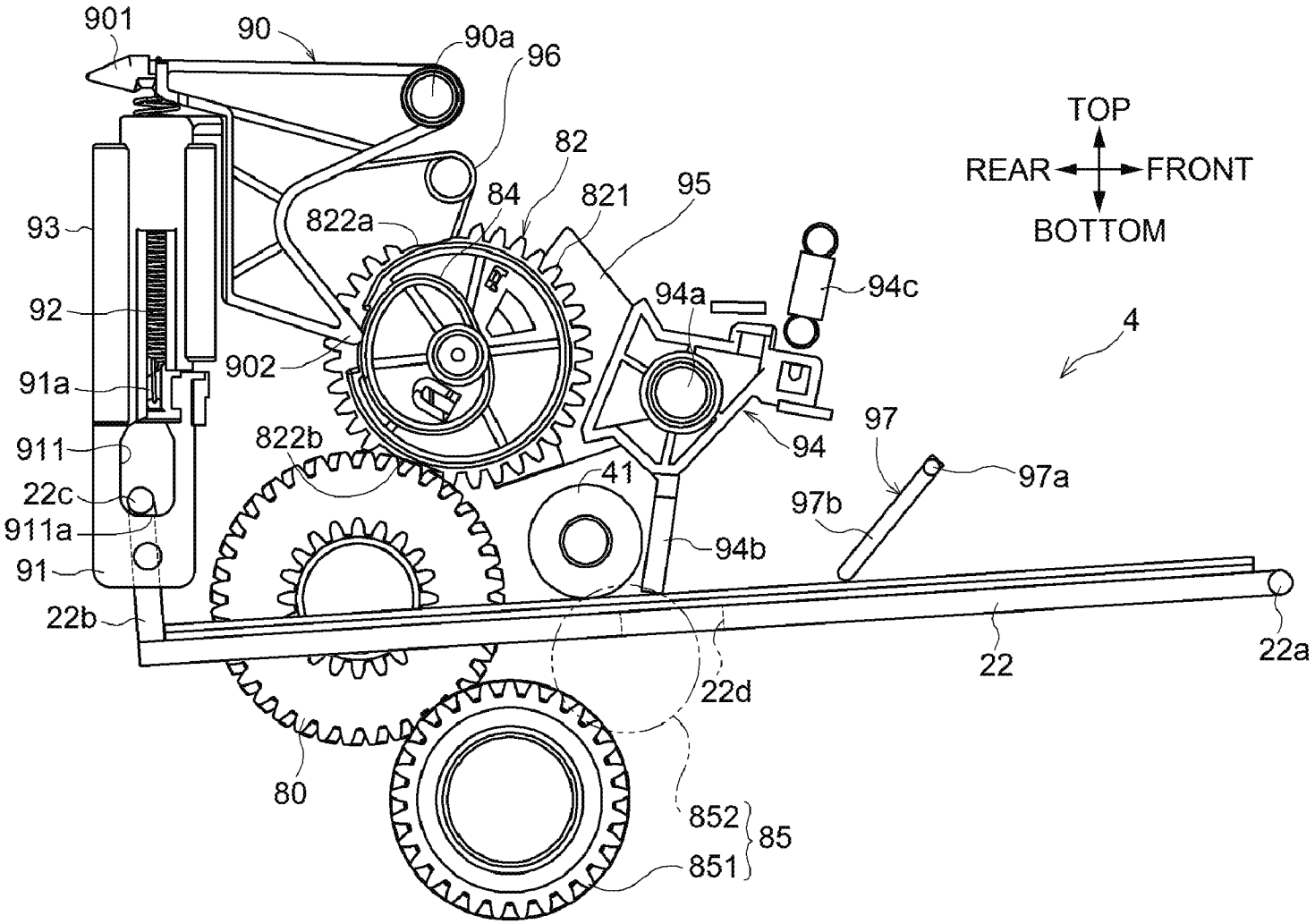
FIG. 7 is a left side view of the sheet conveying device in which the selector lever is at the second lever position and the support tray is at a sheet feed position.

As illustrated in FIGS. 7 and 8, when the sector gear 82 engaging with the drive gear 80 rotates to a position where the second toothless portion 822*b* faces the drive gear 80, the toothed portion 821 disengages from the drive gear 80, and thus the sector gear 82 is cut off from the drive force from the drive gear 80. The sector gear 82 is, however, rotatable, and the spring 96 engages with the second engaging piece 834, urging the sector gear 82 in the rotation direction. The sector gear 82 receives the urging force of spring 96 and rotates to a position where the second hook portion 952 of the hook 95 engages with the second cam portion 832. When the sector gear 82 rotates to the position where the second hook portion 952 engages with the second cam portion 832, the second toothless portion 822*b* faces the drive gear 80, and thus the sector gear 82 disengages from the drive gear 80.

When the sector gear 82 rotates to the position where the second toothless portion 822*b* faces the drive gear 80, the cam 84 moves the arm 90 to the first position, which allows the support tray 22 to pivot to the sheet feed position. When the support tray 22 pivots to the sheet feed position, the feed roller 41 contacts a sheet S supported on the support tray 22, and the contact pressure between the feed roller 41 and the sheet S increases.

When the support tray 22 pivots from the separation position to the sheet feed position, the support tray 22 moves upward and presses the contact portion 94*b* of the selector lever 94 and the contact portion 94*b* rotates upward. In this case, when the support tray 22 presses the contact portion 94*b* of the selector lever 94 and the contact portion 94*b* rotates upward, the hook 95 may be immovable to maintain engagement between the second hook portion 952 and the second cam portion 832. In other words, when the selector lever 94 moves from the first lever position to the second lever position, the selector lever 94 and the hook 95 may rotate together. When the contact portion 94*b* of the selector lever 94 rotates upward from the second lever position, the selector lever 94 may rotate relative to the hook 95.

The support tray 22 pivots to the sheet feed position, the controller of the image forming apparatus 1 engages the electromagnetic clutch 852, and then rotation of the feed roller 41 starts.

When rotation of the feed roller 41 starts, the feed roller 41 and the separation roller 42 convey a single sheet rearward or toward the image forming unit 5.

The sheet conveying device 4 conveys the required number of sheets S, and then the controller of the image forming apparatus 1 disengages the electromagnetic clutch 852 to stop the sheet conveying device 4.

The electromagnetic clutch 852 is disengaged and the sheet conveying device 4 stops sheet conveyance. If a sheet S remains on the support tray 22, the selector lever 94 is maintained at the second lever position, and thus the support tray 22 remains at the sheet feed position.

As described above, the sheet conveying device 4 controls rotation of the feed roller 41 using the electromagnetic clutch 852, which is different from a drive mechanism to pivot the support tray 22 between the separation position and the sheet feed position. This enables control of the time for the feed roller 41 to feed a sheet S independently of such a drive mechanism, thus increasing a degree of flexibility in the time to feed a sheet S.

After the feed roller 41 feeds all sheets S on the support tray 22, the lower end portion of the contact portion 94*b* is inserted into the sensor hole 22*d*, and the selector lever 94 moves from the second lever position to the first lever position.

When the selector lever 94 moves to the first lever position, the second hook portion 952 of the hook 95 disengages from the second cam portion 832, and the sector gear 82 becomes rotatable.

When the sector gear 82 becomes rotatable with the second toothless portion 822*b* facing the drive gear 80, the urging force of the spring 96 allows the sector gear 82 to rotate to a position where the toothed portion 821, located upstream of the second toothless portion 822*b* in the rotation direction of the sector gear 82, engages with the drive gear 80.

When the toothed portion 821 engages with the drive gear 80, the sector gear 82 receives drive force from the drive gear 80 and rotates. When the sector gear 82 receives drive force from the drive gear 80 and rotates to the position where the first toothless portion 822*a* faces the drive gear 80, the cam 84 moves the arm 90 to the second position. As illustrated in FIG. 3, when the arm 90 is at the second position, the support tray 22 is at the separation position and is apart from the feed roller 41.

When the sector gear 82 rotates to a position where the first toothless portion 822*a* faces the drive gear 80, the toothed portion 821 disengages from the drive gear 80, and thus the sector gear 82 is cut off from the drive force from the drive gear 80. The sector gear 82 is, however, rotatable, and the spring 96 engages with the first engaging piece 833, urging the sector gear 82 in the rotation direction. The sector gear 82 receives the urging force of spring 96 and rotates to a position where the first hook portion 951 of the hook 95 engages with the first cam portion 831. The sheet conveying device 4 thus returns to its initial state.

In the sheet conveying device 4, a sheet S supported on the support tray 22 contacts the contact portion 94*b* of the selector lever 94, the selector lever 94 moves from the first lever position to the first lever position, and the support tray 22 moves toward the feed roller 41, thereby increasing pressure between the feed roller 41 and the sheet S.

This structure does not require a solenoid, but enables the sheet conveying device 4 to increase the contact pressure between the feed roller 41 and a sheet S on the support tray 22.

In this structure, a sheet S is inserted to contact and move the selector lever 94 from the first position to the second position. This rotates the cam 84, which moves the arm 90 from the second position to the first position and the support tray 22 from the separation position to the sheet feed position. The support tray 22 can be thus moved to the feed roller 41.

The support tray 22 does not pivot between the separation position and the sheet feed position when every sheet S is conveyed. The support tray 22 remains at the sheet feed position until it becomes empty. This provides stable positioning of sheets S on the support tray 22, and prevents the occurrence of noise.

When a sheet S is inserted on the support tray 22 at the separation position, the sheet S contacts and stops at the step formed between the support surface 2C and the guide surface 2B in the casing 2.

This prevents the sheet S inserted on the support tray 22 from reaching a nip portion between the separation roller 42 and the separation pad 43, thus reducing the possibility of improperly conveying the sheet S.

The contact portion 94*b* of the selector lever 94 extends downward from the pivot shaft 94*a*. When the number of sheets S to be on the support tray 22 is few, the sheets S can contact a portion of the contact portion 94*b* away from the pivot shaft 94*a*, which is going to help the selector lever 94 to pivot with a small force.

The contact portion 94*b* of the selector lever 94 can be used as a contact of a sheet sensor for detecting whether the support tray 22 supports a sheet S.

Figure 9A:
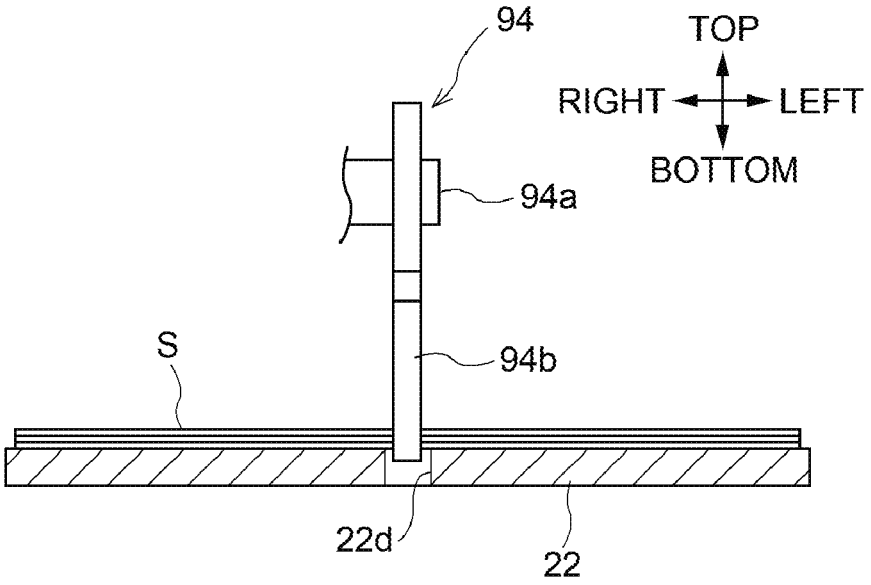
FIG. 9A is a partial sectional view from the rear, illustrating the selector lever located at a central portion of the support tray in its width direction, and the support tray supporting sheets having a width equal to the maximum width available in the support tray.
Figure 9B:
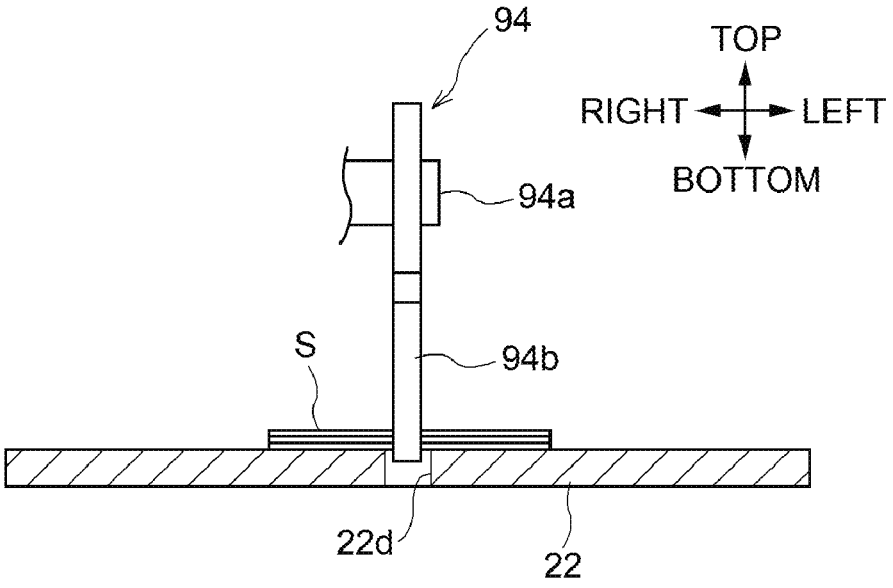
FIG. 9B is a partial sectional view from the rear, illustrating the selector lever located at the central portion of the support tray in the width direction, and the support tray supporting sheets having a width equal to the minimum width available in the support tray.

As illustrated in FIGS. 9A and 9B, the selector lever 94 may be disposed at a central portion of the support tray 22 in a width direction orthogonal to the sheet conveyance direction.

As illustrated in FIG. 9A, when the selector lever 94 is disposed at the central portion of the support tray 22 in the width direction and the support tray 22 supports sheets S having a width equal to the maximum width available in the support tray 22, the sheets S can contact the contact portion 94*b* to move the selector lever 94 from the first lever position to the second lever position.

As illustrated in FIG. 9B, when the support tray 22 supports sheets S having a width equal to the minimum width available in the support tray 22, the sheets S can contact the contact portion 94*b* to move the selector lever 94 from the first lever position to the second lever position.

As the selector lever 94 is located in the central portion of the support tray 22 in the width direction, various sized sheets S having widths ranging from the maximum width to the minimum width available in the support tray 22 can contact and move the selector lever 94 from the first lever position to the second lever position.

Second Embodiment of Sheet Conveying Device

The sheet conveying device 4 according to the first embodiment includes the feed roller 41, the support tray 22, and the drive mechanism. The feed roller 41 is not movable vertically. The drive mechanism moves the support tray 22 to the feed roller 41, thereby increasing the contact pressure between the feed roller 41 and a sheet S on the support tray 22. The sheet conveying device 4 may be configured as described below.

In the sheet conveying device 4, for example, the support tray 22 may not be movable vertically, and the drive mechanism may move the feed roller 41 to the support tray 22, thereby increasing the contact pressure between the feed roller 41 and a sheet S on the support tray 22.

The second embodiment eliminates descriptions about the selector lever 94, the hook 95, the rock cam 83, the spring 96, the sector gear 82, the drive gear, the drive force transmitting device 85, and the drive mechanism, which are similar in structure to those described in the first embodiment.

Figure 10:
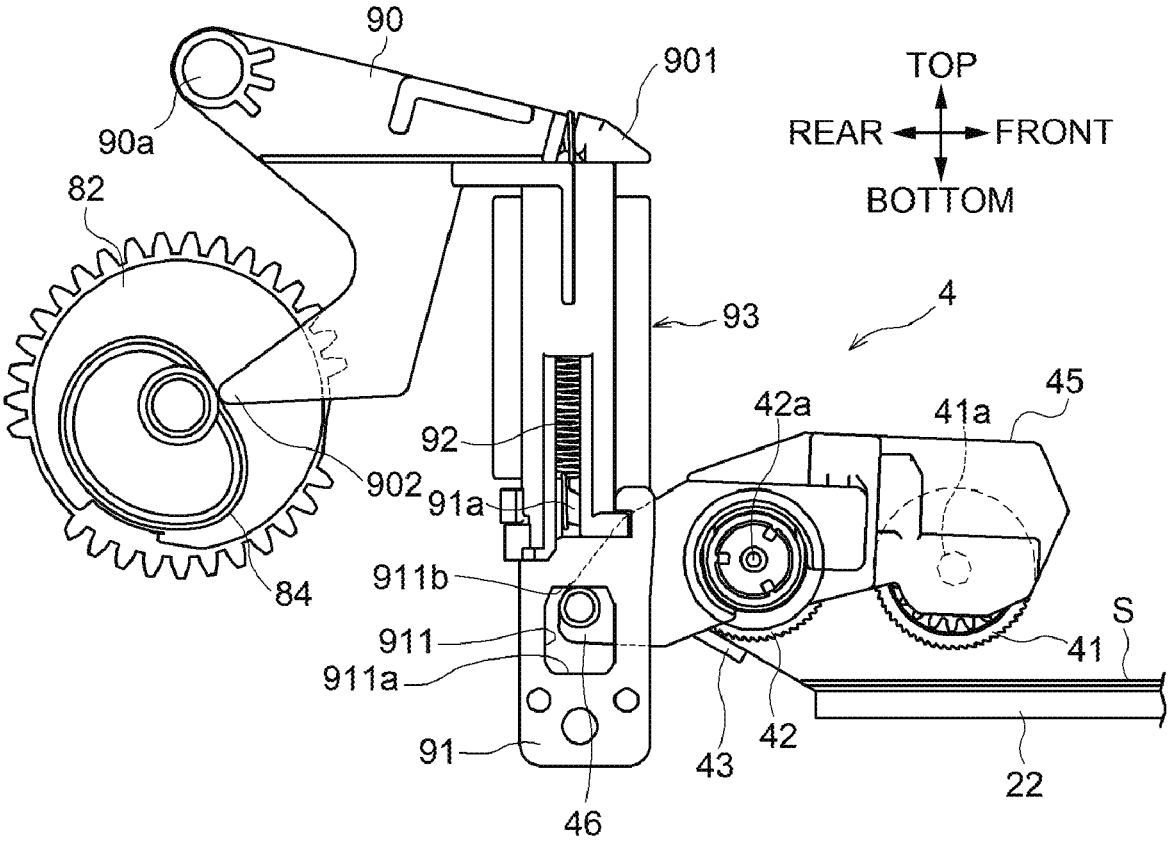
FIG. 10 is a left side view of a sheet conveying device according to a second embodiment, in which a roller holder is at a second position where a feed roller is away from sheets on the support tray.

FIG. 10 illustrates a sheet conveying device 4 according to the second embodiment, in which a support tray 22 is not movable vertically, and a roller holder 45 supports a feed roller 41 and the separation roller 42 and is vertically pivotable about a rotation shaft 42*a* of the separation roller 42. The roller holder 45 includes a protrusion 46 protruding therefrom in the left-right direction.

The feed roller 41 is disposed in front of the rotation shaft 42*a* and the protrusion 46*a* is disposed at the rear of the rotation shaft 42*a*. The feed roller 41 is pivotable about the rotation shaft 42*a*. When subjected to no external force, the feed roller 41 pivots downward by its own weight to contact a sheet S on the support tray 22.

When the protrusion 46 of the roller holder 45 receives an upward load, a force having a direction to pivot the feed roller 41 downward is applied to the roller holder 45, and thus the feed roller 41 is pressed against the sheet S on the support tray 22. Specifically, the upward load exerted on the protrusion 46*a* increases the contact pressure between the feed roller 41 and the sheet S supported on the support tray 22.

When the protrusion 46 of the roller holder 45 receives a downward load, a force having a direction to pivot the roller holder 45 upward is applied to the roller holder 45, and thus the feed roller 41 pivots away from the sheet S on the support tray 22 against its own weight.

The roller holder 45 is movable between a first position where the feed roller 41 is in contact with the sheet S and a second position where the feed roller 41 is away from the sheet S.

The protrusion 46 of the holder 45 engages in the hole 911 in the contact 91. The hole 911 has an inner surface defining its circumference. The inner surface of the hole 911 includes a bottom surface 911 and an upper surface 911*b*.

As illustrated in FIG. 10, when the arm 90 is at the second position, the contact 91 is at a down position with the protrusion 46 in contact with and pressed downward by the upper surface 911*b* of the hole 911. When the protrusion 46 is pressed downward, the feed roller 41 pivots to the second position, away from the sheet S.

Figure 11:
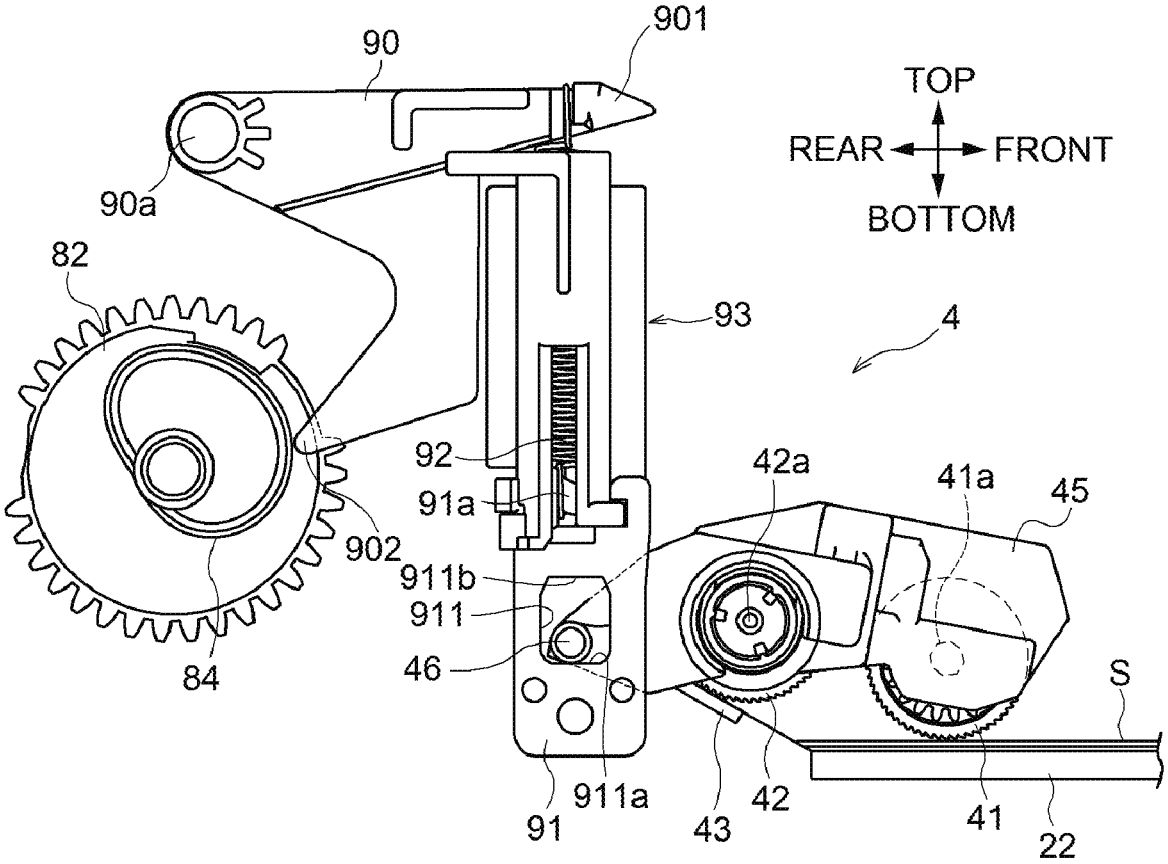
FIG. 11 is a left side view of the sheet conveying device according to the second embodiment, in which the roller holder is at a first position where the feed roller is in contact with a sheet on the support tray.

As illustrated in FIG. 11, when the arm 90 is at the first position, the contact 91 is at an up position with the protrusion 46 in contact with and pressed upward by the bottom surface 911*a* of the hole 911. When the protrusion 46 is pressed upward, the feed roller 41 pivots to the first position and presses the sheet S on the support tray 22, thus increasing the contact pressure between the feed roller 41 and the sheet S.

In the sheet conveying device 4, movement of the arm 90 of the drive mechanism from the second position to the first position enables the feed roller 41 to move to the support tray 22, thus increasing the contact pressure between the feed roller 41 and the sheet S on the support tray 22.

In the sheet conveying device 4, a sheet S supported on the support tray 22 contacts the contact portion 94*b* of the selector lever 94, the selector lever 94 moves from the first lever position to the first lever position, and the feed roller 41 moves toward the support tray 22, thereby increasing pressure between the feed roller 41 and the sheet S.

Effects of the Embodiments

In the above embodiments, the image forming apparatus 1 includes the sheet conveying device 4 configured as described below.

Specifically, the sheet conveying device 4 includes the support tray 22, the selector lever 94, the hook 95, the rock cam 83, the spring 96, the drive gear 80, the feed roller 41, and the drive mechanism.

The support tray 22 supports one or more sheets S. The selector lever 94 is located to contact a sheet S supported on the support tray 22, and is pivotable by contact with the sheet S. The hook 95 is movable together with the selector lever 94. The rock cam 83 is rotatable and engageable with the hook 95. Rotation of the rock cam 83 is restricted by engagement with the hook 95. The spring 96 urges the rock cam 83 in the rotation direction. The sector gear 82 is rotatable together with the rock cam 83. The drive gear 80 is engageable with the sector gear 82. The drive gear 80 transmits a drive force to the sector gear 82 when engaging with the sector gear 82. The feed roller 41 is rotatable to contact and feed a sheet S supported on the support tray 22. The drive mechanism receives the drive force from the sector gear 82, and moves one of the feed roller 41 and the support tray 22 toward the other one, to increase the contact pressure between the feed roller 41 and the sheet S on the support tray 22.

When a sheet S on the support tray 22 contacts the contact portion 94*b* of the selector lever 94, the drive mechanism works to increase the contact pressure between the sheet S and the feed roller 41. Thus, the sheet conveying device 4 does not require a solenoid, but enables increase of the contact pressure between the feed roller 41 and a sheet S on the support tray 22.

The first embodiment shows that the support tray 22 is pivotable and the drive mechanism includes the cam 84 rotatable together with the rock cam 83, the arm 90 configured to pivot along with the rotation of the cam 84, and the connector connecting the arm 90 and the support tray 22.

Thus, when a sheet S on the support tray 22 contacts the selector lever 94, this structure allows the selector lever 94 to pivot, which allows the support tray 22 to move to the feed roller 41.

The first embodiment further shows the drive force transmission device 85 configured to transmit the drive force from the drive gear 80. The drive force transmission device 85 includes the electromagnetic clutch 852 configured to selectively engage or disengage the feed roller 41.

This enables control of the time for the feed roller 41 to feed a sheet S independently of the drive mechanism.

The selector lever 94 is disposed above the support tray 22 and includes the pivot shaft 94*a* and the contact portion 94*b*. The selector lever 94 is pivotable about the pivot shaft 94*a*. The contact portion 94*b* is located below the pivot shaft 94*a* to contact a sheet S.

Thus, when the number of sheets S to be on the support tray 22 is few, the sheets S can contact a portion of the contact portion 94*b* away from the pivot shaft 94*a*, which is going to help the selector lever 94 to pivot with a small force.

The selector lever 94 is disposed at the central portion of the support tray 22 in the width direction orthogonal to the sheet conveyance direction.

Thus, the selector lever 94 is pivotable with any sheets extending in the width direction.

The sheet conveying device 4 further includes the sheet pressing lever 97 disposed upstream of the selector lever 94 in the sheet conveyance direction and configured to press a sheet S on the support tray 22 toward the support tray 22.

Even a single sheet S on the support tray 22 will have greater stiffness when pressed by the sheet pressing lever 97, thus enabling the selector lever 94 to pivot.

What is claimed is:

1. A sheet conveying device, comprising:

a sheet supporting portion configured to support a sheet;

a first lever pivotable by contact with the sheet supported by the sheet supporting portion;

a hook movable together with the first lever;

a first cam rotatable and engageable with the hook, the first cam being configured to, when engaging the hook, stop rotating in a rotation direction of the first cam;

a spring configured to urge the first cam in the rotation direction;

a sector gear rotatable together with the first cam;

a drive gear engageable with the sector gear, the drive gear being configured to, when engaging the sector gear, transmit a drive force to the sector gear;

a feed roller rotatable in contact with the sheet supported by the sheet supporting portion and configured to feed the sheet; and a drive mechanism configured to receive the drive force from the sector gear and move one of the feed roller and the sheet supporting portion toward the other of the feed roller and the sheet supporting portion, to increase contact pressure between the feed roller and the sheet supported by the sheet supporting portion.

2. The sheet conveying device according to claim 1, wherein the sheet supporting portion is pivotable, and wherein the drive mechanism includes:

a second cam rotatable together with the first cam;

an arm disposed in contact with the second cam, the arm being pivotable with rotation of the second cam; and a connector connecting the arm and the sheet supporting portion.

3. The sheet conveying device according to claim 1, further comprising a drive force transmission device configured to transmit a drive force from the drive gear to the feed roller, the drive force transmission device including an electromagnetic clutch configured to selectively allow and interrupt transmission of a drive force to the feed roller.

4. The sheet conveying device according to claim 1, wherein the first lever includes a pivot shaft and a contact portion, the pivot shaft being disposed above the sheet supporting portion, the first lever being pivotable about the pivot shaft, the contact portion being located below the pivot shaft and configured to contact the sheet.

5. The sheet conveying device according to claim 1, wherein the first lever is disposed at a central portion of the sheet supporting portion in a width direction orthogonal to a sheet conveyance direction.

6. The sheet conveying device according to claim 1, further comprising a second lever disposed upstream of the first lever in a sheet conveyance direction.

7. An image forming apparatus comprising:

an image forming unit configured to form an image on a sheet; and a sheet conveying device configured to convey a sheet toward the image forming unit, the sheet conveying device including:

a sheet supporting portion configured to support a sheet;

a first lever pivotable by contact with the sheet supported by the sheet supporting portion;

a hook movable together with the first lever;

a first cam rotatable and engageable with the hook, the first cam being configured to, when engaging the hook, stop rotating in a rotation direction of the first cam;

a spring configured to urge the first cam in the rotation direction;

a sector gear rotatable together with the first cam;

a drive gear engageable with the sector gear, the drive gear being configured to, when engaging the sector gear, transmit a drive force to the sector gear;

a feed roller rotatable in contact with the sheet supported by the sheet supporting portion and configured to feed the sheet; and a drive mechanism configured to receive the drive force from the sector gear and move one of the feed roller and the sheet supporting portion toward the other of the feed roller and the sheet supporting portion, to increase contact pressure between the feed roller and the sheet supported by the sheet supporting portion.

* * * * *